US010262607B2

(12) United States Patent
Ma

(10) Patent No.: US 10,262,607 B2
(45) Date of Patent: Apr. 16, 2019

(54) DRIVING CIRCUITS OF LIQUID CRYSTAL PANELS AND LIQUID CRYSTAL DISPLAYS

(71) Applicant: WUHAN CHINA STAR OPTOELECTRONICS TECHNOLOGY CO., LTD, Hubei (CN)

(72) Inventor: Liang Ma, Guangdong (CN)

(73) Assignee: Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 22 days.

(21) Appl. No.: 15/526,990

(22) PCT Filed: May 12, 2017

(86) PCT No.: PCT/CN2017/084123

§ 371 (c)(1),
(2) Date: May 15, 2017

(87) PCT Pub. No.: WO2018/176588

PCT Pub. Date: Oct. 4, 2018

(65) Prior Publication Data

US 2018/0286332 A1 Oct. 4, 2018

(51) Int. Cl.
*G09G 3/36* (2006.01)

(52) U.S. Cl.
CPC ..... *G09G 3/3614* (2013.01); *G09G 3/3677* (2013.01); *G09G 2310/0297* (2013.01); *G09G 2310/08* (2013.01); *G09G 2320/0247* (2013.01)

(58) Field of Classification Search
None
See application file for complete search history.

(56) References Cited

U.S. PATENT DOCUMENTS

2015/0161927 A1* 6/2015 Hekstra ..... G09G 3/3614 345/209
2016/0180791 A1* 6/2016 Lee ..... G09G 3/3648 345/213

FOREIGN PATENT DOCUMENTS

CN 103578432 A 2/2014
CN 205336415 U 6/2016
(Continued)

OTHER PUBLICATIONS

U.S. Appl. No. 12/136,261, filed Sep. 17, 2009, Sheng Chao Liu et al.

*Primary Examiner* — Kenneth B Lee, Jr.
(74) *Attorney, Agent, or Firm* — Andrew C. Cheng

(57) ABSTRACT

The present disclosure relates to a driving circuit for liquid crystal panels and a liquid crystal display. The driving circuit of a liquid crystal panel includes a demultiplexer circuit and an inversion switching circuit. Two input ends of the inversion switching circuit input two kinds of data signals having opposite polarity. The output ends of the inversion switching circuit respectively connect to the input end of the demultiplexer circuit. The output end of the demultiplexer circuit respectively connects to the data lines in the odd rows and the even rows. By adding the inversion switching circuit in the input side of the data signals of the demultiplexer circuit, the two input ends of the inversion switching circuit are alternatively connected with the two output ends of the inversion switching circuit while scanning a row of sub-pixels.

19 Claims, 5 Drawing Sheets

(56) References Cited

FOREIGN PATENT DOCUMENTS

| | | | |
|---|---|---|---|
| CN | 105869599 | A | 8/2016 |
| CN | 106125427 | A | 11/2016 |

* cited by examiner

DRIVING CIRCUITS OF LIQUID CRYSTAL PANELS AND LIQUID CRYSTAL DISPLAYS

BACKGROUND OF THE INVENTION

1. Field of the Invention

The present disclosure relates to liquid crystal panel technology, and more particularly to a driving circuit of a liquid crystal panel and a liquid crystal display.

2. Discussion of the Related Art

Nowadays, the liquid crystal display (LCD) has played an important role in consumer electronic device. The LCD is widely applied in displays of mobile terminals that have a high resolution color display, wherein the thin film transistor (TFT) LCD is one of the main LCDs.

To avoid damaging the polarity of liquid crystal in the pixel of liquid crystal, the image voltage in one end of the pixel of the liquid crystal needs to be changed continuously, that is higher or lower the other end, the common voltage. The voltage difference is the same, such that the polarity in each pixel of the liquid crystal has been changed continuously, but the gray scale of the image is not changed. The method for the polarity inversion includes frame-inversion, row-inversion, column-inversion and dot-inversion. At present, the manufacturer of the LCD utilizes the demultiplexer circuit to distribute wires, realizing the column-inversion of the LCD. However, as the size of the LCD is increasingly larger, if the polarities in the two adjacent pixels are the same, users can see the flicker in the moving range, such that the effect of image is not good and the quality of image is bad.

SUMMARY

The present disclosure relates to a driving circuit of a liquid crystal panel and a liquid crystal display. The driving circuit of the present disclosure realizes the dot-inversion of the liquid crystal panel, so as to improve the image quality of the liquid crystal display.

In one aspect, a driving circuit of a liquid crystal panel is provided. The driving circuit includes a demultiplexer circuit and an inversion switching circuit.

The demultiplexer circuit includes first type switches, second type switches, and a plurality of distribution wires. An input end of each of the first type switches is connected with a first output end of the inversion switching circuit. An output end of each of the first type switches is connected with one of first data lines of the liquid crystal panel. A control end of each of the first type switches is connected with one of the distribution wires. An input end of each of the second type switches is connected with a second output end of the inversion switching circuit. An output end of each of the second type switches is connected with one of second data lines of the liquid crystal panel. A control end of each of the second type switches is connected with one of the distribution wires. Each of the distribution wires is configured for outputting different distribution signals to turn on the corresponding switches in different time intervals within a scanning period. A set of the distribution wires is shared by the first type switches and the second type switches.

A first input end of the inversion switching circuit is configured for inputting first data signals of the first data lines. A second input end of the inversion switching circuit is configured for inputting second data signals of the second data lines. The first output end of the inversion switching circuit is connected with the input ends of the first type switches of the demultiplexer circuit. The second output end of the inversion switching circuit is connected with the input ends of the second type switches of the demultiplexer circuit. The first input end and the second input end of the inversion switching circuit is respectively connected with the first output end and the second output end of the inversion switching circuit, and the first input end and the second input end of the inversion switching circuit are alternatively connected with the first output end and the second output end of the inversion switching circuit while scanning a row of sub-pixels.

Wherein the first data lines and the second data lines are respectively the odd-number columns of data lines and the even-number columns of data lines, and a polarity of the first data signals is opposite to the polarity of the second data signals.

In another aspect, a driving circuit of a liquid crystal panel is provided. The driving circuit includes a demultiplexer circuit and an inversion switching circuit.

The demultiplexer circuit includes a first input end and a second input end, and is configured for outputting data signals inputted by the first input end to first data lines of the liquid crystal panel, and for outputting data signals inputted by the second input end to second data lines of the liquid crystal panel, wherein each of the data lines of the liquid crystal panel is connected with a column of sub-pixels.

A first input end of the inversion switching circuit is configured for inputting first data signals. A second input end of the inversion switching circuit is configured for inputting second data signals. A first output end of the inversion switching circuit is connected with the first input end of the demultiplexer circuit. A second output end of the inversion switching circuit is connected with the second input end of the demultiplexer circuit. The first input end and the second input end of the inversion switching circuit are respectively connected with the first output end and the second output end of the inversion switching circuit, and the first input end and the second input end of the inversion switching circuit are alternatively connected with the first output end and the second output end of the inversion switching circuit while scanning a row of the sub-pixels.

Wherein the first data lines and the second data lines are respectively the odd-number columns of data lines and the even-number columns of data lines, and a polarity of the first data signals is opposite to the polarity of the second data signals.

In another aspect, a liquid crystal display (LCD) is provided. The LCD includes a driving circuit and a liquid crystal panel. The liquid crystal panel includes a plurality of data lines, a plurality of scan lines, and a plurality of pixels. The pixels include a plurality of sub-pixels. The driving circuit is configured for driving the liquid crystal panel.

Wherein the driving circuit includes a demultiplexer circuit and an inversion switching circuit.

The demultiplexer circuit includes a first input end and a second input end, and is configured for outputting data signals inputted by the first input end of the demultiplexer circuit to first data lines of the liquid crystal panel, and for outputting data signals inputted by the second input end of the demultiplexer circuit to second data lines of the liquid crystal panel, wherein each of the data lines of the liquid crystal panel is connected with a row of the sub-pixels.

A first input end of the inversion switching circuit is configured for inputting first data signals. A second input end of the inversion switching circuit is configured for inputting second data signals. A first output end of the inversion switching circuit is connected with the first input end of the demultiplexer circuit. A second output end of the inversion switching circuit is connected with the second input end of the demultiplexer circuit. The first input end and the second input end of the inversion switching circuit are respectively connected with the first output end and the second output end of the inversion switching circuit, and the first input end and the second input end of the inversion switching circuit are alternatively connected with the first output end and the second output end of the inversion switching circuit while scanning a row of the sub-pixels.

Wherein the first data lines and the second data lines are respectively the odd-number columns of data lines and the even-number columns of data lines, and a polarity of the first data signals is opposite to the polarity of the second data signals.

In view of the above, the driving circuit of the disclosure includes a demultiplexer circuit and an inversion switching circuit. Two input ends of the inversion switching circuit input two types of data signals in which a polarity of one type of data signals is opposite to the polarity of the other type of data signals. The output ends of the inversion switching circuit are respectively connected with input ends of the demultiplexer circuit. Output ends of the demultiplexer circuit are respectively connected with odd-number columns of data lines and even-number columns of data lines. By adding the inversion switching circuit in the input side of the data signals of the demultiplexer circuit, the two input ends of the inversion switching circuit are alternatively connected with the two output ends of the inversion switching circuit while scanning a row of sub-pixels, such that the polarities of the data signals of the different type data lines inputted by the demultiplexer circuit are opposite; and the polarities of the data signals inputted by the same data line are opposite during the two adjacent scan, such that the polarities of the data signals of the two adjacent sub-pixels in the liquid crystal panel are opposite without changing the polarities of the driving signals outputted by the driving chip, realizing the dot-inversion of the liquid crystal panel, so as to improve the image quality.

DETAILED DESCRIPTION OF THE EMBODIMENTS

Among the specification and the scope of subsequent terms are used to refer to specific components. Those of skill in the art will appreciate that manufacturers may use different terms to refer to the same components. The patent specification and subsequent differences in the name of the range is not to be used as a way to distinguish between the components, but with differences in the functional components as distinguished benchmarks. Embodiments of the invention will now be described more fully hereinafter with reference to the accompanying drawings, in which embodiments of the invention are shown.

Figure 1:
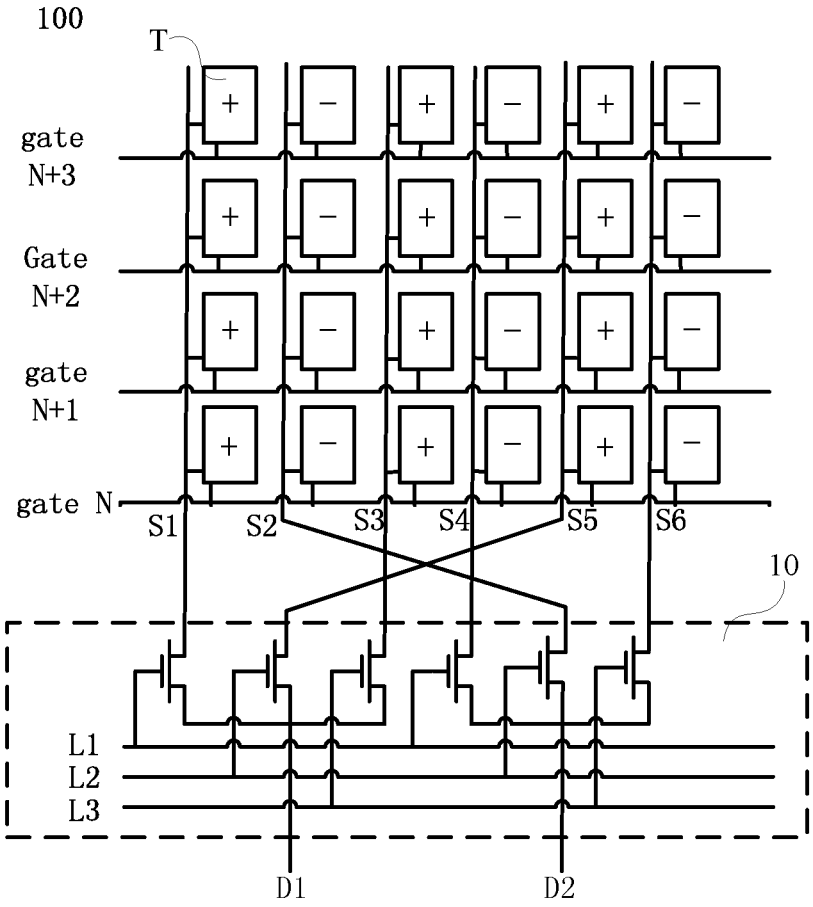
FIG. 1 is a schematic view of the liquid crystal panel and the driving circuit in the conventional art.

Referring to FIG. 1, FIG. 1 is a schematic view of the liquid crystal panel and driving circuit in the conventional art. As shown in FIG. 1, the panel includes a plurality of sub-pixels T (R, G, B sub-pixels T), a plurality of scan lines gate 1, . . . , gate N+3, and a plurality of data lines S1, . . . , S6. The scan lines gate 1, . . . , gate N+3 and the data lines S1, . . . , S6 are intersected each other. Each of the sub-pixels T is disposed on the intersections of the scan lines gate 1, . . . , gate N+3 and the data lines S1, . . . , S6. The driving circuit in the conventional art includes a plurality of data buses D1, D2 and a demultiplexer circuit 10. Each of the data buses D1, D2 is connected with certain amount of the data lines S1, . . . , S6 through the demultiplexer circuit 10. The two adjacent data buses D1, D2 are separated with each other through the data lines S1, . . . , S6 being connected with the demultiplexer circuit 10. The polarities of the data signals outputted by every two adjacent data buses D1, D2 are opposite to each other. The data signals in which the polarities are opposite to each other are transmitted to the separated data lines S1, . . . , S6, such that the polarities of the data signals in the two adjacent column of the sub-pixels are opposite to each other. However, as the size of the panel is increasingly larger, the conventional structure of the driving circuit cannot meet the need of human's eye, such that user can see the flicker of the panel.

To improve the image quality of the panel, a driving circuit of a liquid crystal panel of the present disclosure is provided. The driving circuit includes a demultiplexer circuit and an inversion switching circuit. The demultiplexer circuit includes a first input end and a second input end. The data signals inputted by the first input end output to odd-number columns of data lines of the liquid crystal panel. The data signals inputted by the second input end output to even-number columns of data lines. Each of the data lines in the panel is connected with a column of sub-pixels. That is, the data signals inputted by the first input end output to odd-number columns of sub-pixels, and the data signals inputted by the second input end output to even-number columns of sub-pixels. A first input end of the inversion switching circuit is connected with a data bus. A second input end of the inversion switching circuit is connected with another data bus which is adjacent to the data bus. A polarity of the data signals inputted by the first input end of the inversion switching circuit is opposite to the polarity of the data signals inputted by the second input end of the inversion switching circuit. A first output end of the inversion switching circuit is connected with the first input end of the demultiplexer circuit. A second output end of the inversion switching circuit is connected with the second output end of the demultiplexer circuit. Furthermore, each of the input ends of the inversion switching circuit is respectively connected with one of the output ends of the inversion switching circuit, and the two input ends of the inversion switching circuit are alternatively connected with the two output ends of the inversion switching circuit while scanning a row of the sub-pixels, such that the polarities of the data signals in the two adjacent sub-pixels of the liquid crystal panel are opposite to each other through the inversion switching circuit and the demultiplexer circuit, so as to realize the dot-inversion of the liquid crystal panel.

Figure 2:
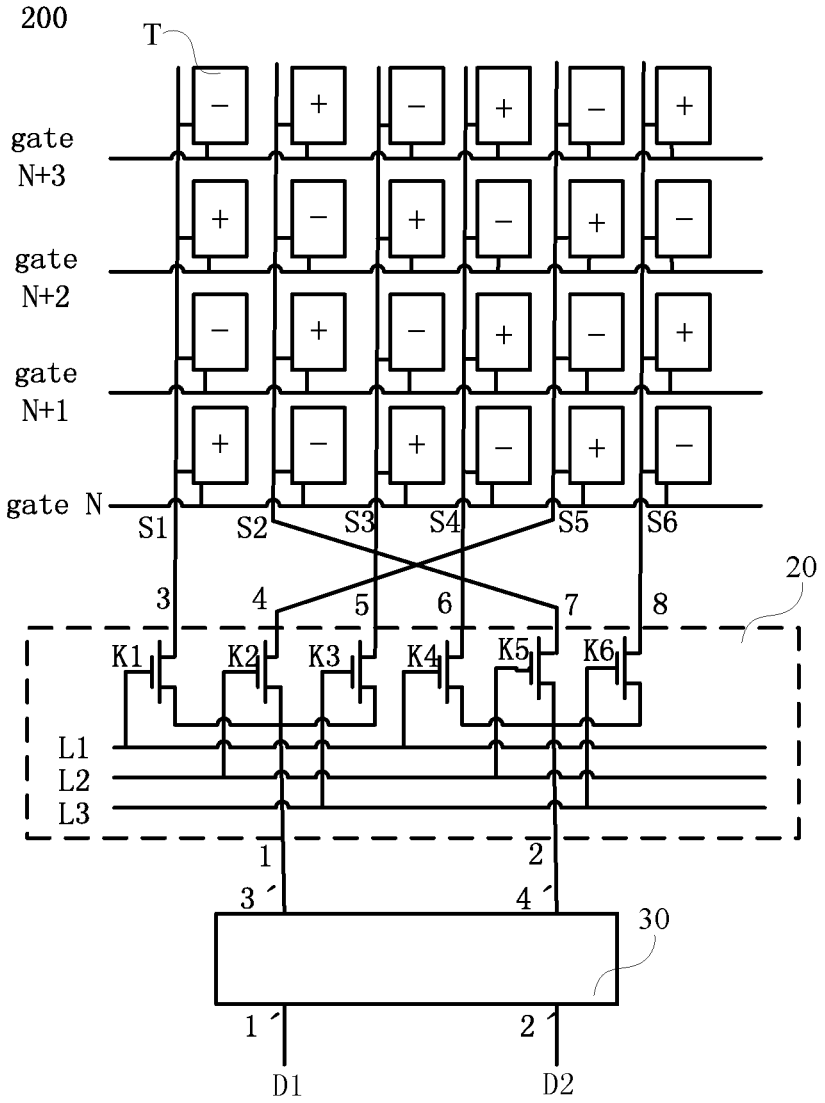
FIG. 2 is a schematic view of the diving circuit of the liquid crystal panel in accordance with one embodiment of the present disclosure.

Specifically, referring to FIG. 2, FIG. 2 is a schematic view of the driving circuit of the liquid crystal panel in accordance with one embodiment of the present disclosure. As shown in FIG. 2, the driving circuit 200 includes a demultiplexer circuit 20 and an inversion switching circuit 30. Data signals inputted by a first input end 1 of the demultiplexer circuit 20 output to odd-number columns of data lines S1, S3, S5. Data signals inputted by a second input end 2 of the demultiplexer circuit 20 output to even-number columns of data lines S2, S4, S6. Each of the data lines S1, S2, S3, S4, S5, S6 in the liquid crystal panel is connected with a column of sub-pixels T. That is, the data signals inputted by the first input end 1 of the demultiplexer circuit 20 output to odd-number columns of sub-pixels T of the panel. The data signals inputted by the second input end 2 of the demultiplexer circuit 20 output to even-number columns of sub-pixels T of the panel. A first input end 1' of the inversion switching circuit 30 is connected with a data bus D1, and a second input end 2' of the inversion switching circuit 30 is connected with another data bus D2 which is adjacent to the data bus D1. A polarity of the data signals in the data bus D1 is opposite to the polarity of the data signals in the data bus D2, that is, the polarities of the data signals in the two adjacent data buses D1, D2 are opposite to each other. A first output end 3' of the inversion switching circuit 30 is connected with the first input end 1 of the demultiplexer circuit 20, and a second output end 4' of the inversion switching circuit 30 is connected with the second input end 2 of the demultiplexer circuit 20. Furthermore, each of the input ends 1', 2' of the inversion switching circuit 30 is respectively connected with one of the output end 3', 4' of the inversion switching circuit 30, and the two input ends 1', 2' of the inversion switching circuit 30 are alternatively connected with the two output ends 3', 4' of the inversion switching circuit 30 while scanning a row of sub-pixels. For example, the first input end 1' is connected with the first output end 3', and the second input end 2' is connected with the second output end 4' while scanning a N-th row of the sub-pixels; the first input end 1' is connected with the second output end 4', and the second input end 2' is connected with the first output end 3' while scanning a (N+1)-th row of the sub-pixels, such that the polarities of the data signals in the two adjacent sub-pixels T of the liquid crystal panel outputted through the inversion switching circuit 30 and the demultiplexer circuit 20 are opposite to each other, realizing the dot-inversion of the liquid crystal panel.

It will be appreciated that the driving circuit 200 of the liquid crystal panel in the FIG. 2 is only one part of the driving circuit of the present disclosure. In practice, the amount of the data buses can be designed and adjusted according to the actual demand of the liquid crystal panel. This embodiment take the two adjacent data buses as an example, but it cannot be considered that the present disclosure includes only the two data buses. Correspondingly, the amount of the inversion switching circuit can be adaptively adjusted according to the amount of the data buses.

Furthermore, in this embodiment, the demultiplexer circuit includes first type switches, second type switches, and a plurality of distribution wires. Each of input ends of the first type switches is connected with the first output end of the inversion switching circuit. Each of output ends of the first type switches is connected with one of the odd-number columns of the data lines. Each of control ends of the first type switches is connected with one of the distribution wires. Each of input ends of the second type switches is connected with the second output end of the inversion switching circuit. Each of output ends of the second type switches is connected with one of the even-number columns of the data lines. Each of control ends of the second type switches is connected with one of the distribution wires. Each of the distribution wires is configured for outputting different distribution signals to turn on the corresponding switches in different time intervals within a scanning period. It will be appreciated that the number of switches of the first type switches and the second type switches can be designed and adjusted according to the actual need. A set of the distribution wires can be shared by each type switches, at this time, the number of the distribution wires is the same as the number of the switches of each type switches. Besides, the distribution wires in each type switches can be independent each other, at this time, the number of the distribution wires is multiple times of the number of the switches of each type switches.

As shown in FIG. 2, in this embodiment, the first type switches includes switches K1, K2, K3, the second type switches includes switches K4, K5, K6, and the distribution wires are L1, L2, L3. A set of the distribution wire is shared by each type switches. Output ends of the switches K1, K2, K3 are respectively connected with the odd-number columns of the data lines S1, S3, S5, control ends of the switches K1, K2, K3 are respectively connected with the distribution wires L1, L2, L3, and input ends of the switches K1, K2, K3 are connected with the first output end 3' of the inversion switching circuit 30. Output ends of the switches K4, K5, K6 are respectively connected with the even-number columns of the data lines S2, S4, S6, control ends of the switches K4, K5, K6 are respectively connected with the distribution wires L1, L2, L3, and input ends of the switches K4, K5, K6 are connected with the second output end 4' of the inversion switching circuit 30.

Furthermore, the type of switches in each type switches is related to distribution signals of the distribution wires. While the distribution signals of the distribution wires are high levels, the switches of each type switches are N-type switches that can be N-type thin film transistors (TFTs). While the distribution signals of the distribution wires are low levels, the switches of each type switches are P-type switches that can be P-type TFTs.

The scan lines from gate N to gate N+3 in FIG. 2 are respectively corresponding to the sub-pixels T from the N-th row to the (N+3)-th row. When the scan line gate N scans the N-th row of sub-pixels T, control signals of the inversion switching circuit 30 is configured for connecting the first input end 1' with the first output end 3', and for connecting the second input end 2' with the second output end 4', such that the first data signals inputted by the first input ends 1' of the inversion switching circuit 30 are transmitted to the odd-number columns of the sub-pixels T, and the second data signals inputted by the second input ends 2' of the inversion switching circuit 30 are transmitted to the even-number columns of the sub-pixels T. When the scan line gate N+1 scans the (N+1)-th row of sub-pixels T, the control signals of the inversion switching circuit 30 is configured for connecting the first input end 1' with the second output end 4', and for connecting the second input end 2' with the first output end 3', such that the first data signals inputted by the first input ends 1' of the inversion switching circuit 30 are transmitted to the even-number columns of the sub-pixels T, and the second data signals inputted by the second input ends 2' of the inversion switching circuit 30 are transmitted to the odd-number columns of the sub-pixels T. The scan line gate N+2 and the scan line gate N+3 repeat above process, such that the polarities of the data signals in every two adjacent sub-pixels T of the liquid crystal panel are opposite to each other, therefore realizing the dot-inversion of the liquid crystal panel.

Figure 3:
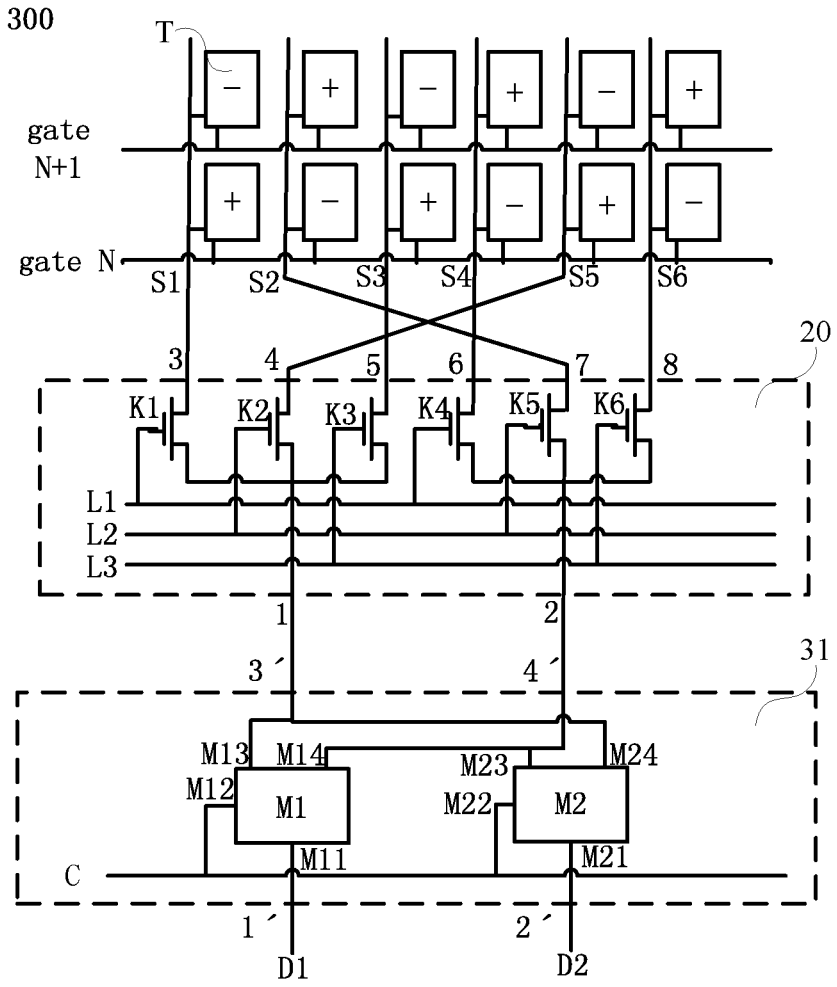
FIG. 3 is a schematic view of the diving circuit of the liquid crystal panel in accordance with another embodiment of the present disclosure.

Furthermore, referring to FIG. 3, FIG. 3 is a schematic view of the diving circuit of the liquid crystal panel in accordance with another embodiment of the present disclosure. As shown in FIG. 3, the inversion switching circuit 31 in this embodiment includes a first switch unit M1, a second switch unit M2, and a control line C. A control end M12 of the first switch unit M1 is connected with the control line C, a input end M11 of the first switch unit M1 is the first input end 1' of the inversion switching circuit 31, a first output end M13 and a second output end M14 of the first switch unit M1 are respectively the first output end 3' and the second output end 4' of the inversion switching circuit 31. The first switch unit M1 is configured for controlling the input end M11 to be connected with the first output end M13 or the second output end M14 according to control signals of the control line C. A control end M22 of the second switch unit M2 is connected with the control line C, a input end M21 of the second switch unit M2 is the second input end 2' of the inversion switching circuit 31, a first output end M23 and a second output end M24 of the second switch unit M2 are respectively the first output end 3' and the second output end 4' of the inversion switching circuit 31. The second switch unit M2 is configured for controlling the input end M21 to be connected with the first output end M23 or the second output end M24 according to the control signals of the control line C. The control line C is configured for providing the control signals to control the input end M11 of the first switch unit M1 and the input end M21 of the second switch unit M2 to be respectively connected with different output ends 3', 4' of the inversion switching circuit 31.

Referring to FIG. 3, the control signals of the control line C control the turn-on or turn-off of the switches of the first switch unit M1 and the second switch unit M2, such that the data signals inputted by the first switch unit M1 are outputted through the first output end 3' of the inversion switching circuit 31 while the data signals inputted by the second switch unit M2 are outputted through the second output end 4' of the inversion switching circuit 31, and the data signals inputted by the first switch unit M1 are outputted through the second output end 4' of the inversion switching circuit 31 while the data signals inputted by the second switch unit M2 are outputted through the first output end 3' of the inversion switching circuit 31.

Figure 4:
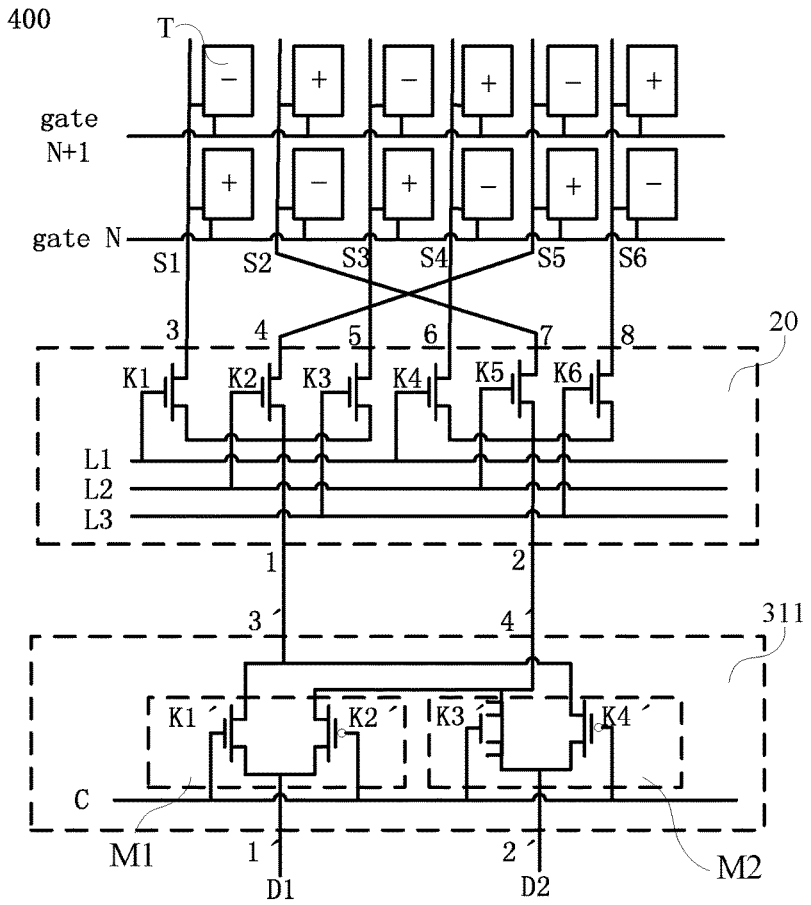
FIG. 4 is a schematic view of the diving circuit of the liquid crystal panel in accordance with another embodiment of the present disclosure.

Furthermore, referring to FIG. 4, FIG. 4 is a schematic view of the diving circuit of the liquid crystal panel in accordance with another embodiment of the present disclosure. As shown in FIG. 4, the first switch unit M1 includes a first switch K1' and a second switch K2'. Control ends of the first switch K1' and the second switch K2' are connected with the control line C, and output ends of the first switch K1' and the second switch K2' are respectively the first output end and the second output end of the first switch unit M1. The second switch unit K2 includes a third switch K3' and a fourth switch K4'. Control ends of the third switch K3' and the fourth switch K4' are connected with the control line C, and output ends of the third switch K3' and the fourth switch K4' are respectively the first output end and the second output end of the second switch unit M2.

In the embodiment, the control line C is a clock control line. The control signals corresponding to each of the switches of the first switch unit M1 and the second switch unit M2 are the same. In order to turn on one part of switches of the first switch unit M1 and the second switch unit M2, and to turn off the other portion of switches of the first switch unit M1 and the second switch unit M2. The type of switches corresponding to the first switch K1' and the third switch K3 are the same, and the type of switches corresponding to the second switch K2' and the fourth switch K4 are the same. In the embodiment, the first switch K1' and the third switch K3' are N-type TFTs, and the second switch K2' and fourth switch K4' are P-type TFTs. The first switch K1' and the third switch K3' are turned on while the control line C outputs high level, and the second switch K2' and the fourth switch K4' are turned on while the control line C outputs low level.

Figure 5:
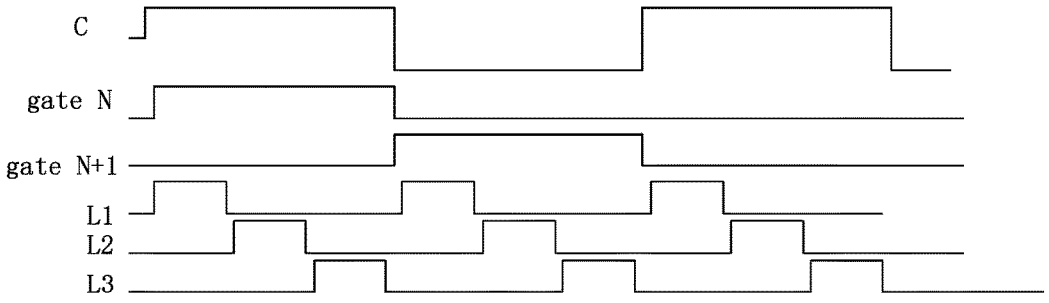
FIG. 5 is a timing diagram of the driving circuit of FIG. 4.

FIG. 5 is a timing diagram of the driving circuit of FIG. 4. Referring to FIG. 4 and FIG. 5, when the scan line gate N scans the N-th row of sub-pixels T, the scan line gate N outputs high level and the control line C outputs high level, at this time, the first switch K1' and the third switch K3' are turned on, and the second switch K2' and the fourth switch K4' are turned off. The first data signals inputted by the first input end 1' of the inversion switching circuit 30 are transmitted to the odd-number columns of the sub-pixels T through the first switch K1' and the first type switches of the demultiplexer circuit 20, and the second data signals inputted by the second input end 2' of the inversion switching circuit 30 are transmitted to the even-number columns of the sub-pixels T through the third switch K3' and the second type switches of the demultiplexer circuit 20, such that the polarities of the data signals of the two adjacent sub-pixels T in the N-th row of sub-pixels T are opposite to each other. When the scan line gate N+1 scans the (N+1)-th row of sub-pixels T, the scan line gate N+1 outputs high level and the control line C outputs low level, at this time, the second switch K2' and the fourth switch K4' are turned on, and the first switch K1' and the third switch K3' are turned off. The first data signals inputted by the first input end 1' of the inversion switching circuit 30 are transmitted to the odd-number columns of the sub-pixels T through the second switch K2' and the second type switches of the demultiplexer circuit 20, and the second data signals inputted by the second input end 2' of the inversion switching circuit 30 are transmitted to the even-number columns of the sub-pixels T through the fourth switch K4' and the first type switches of the demultiplexer circuit 20, such that the polarities of the data signals of the two adjacent sub-pixels T in the (N+1)-th row of sub-pixels T are opposite to each other, and the polarities of the two adjacent sub-pixels T between the N-th row of the sub-pixels T and the (N+1)-th row of the sub-pixels T are also opposite to each other. Therefore, the dot-inversion of the liquid crystal panel is realized without changing the polarities of the data signals within a frame outputted by the driving chip. The distribution wires are configured for outputting the distribution signals to turn on each of the switches of the first type switches and the second type switches in different time intervals.

Figure 6:
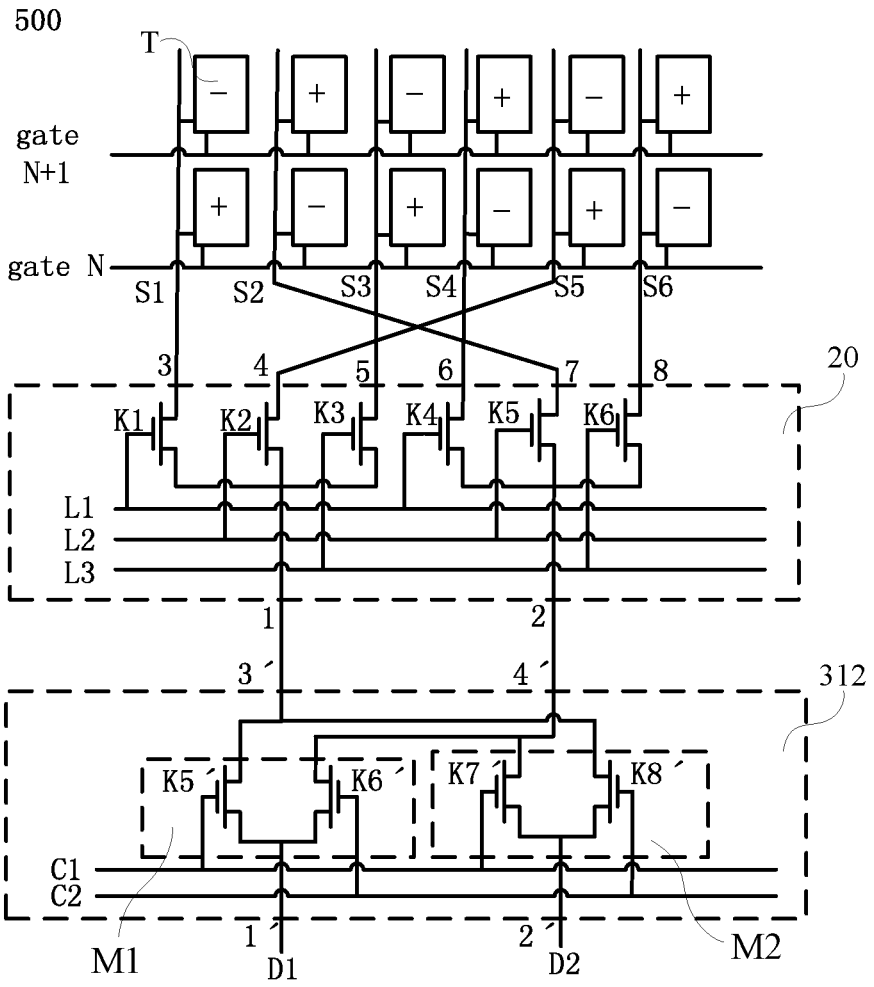
FIG. 6 is a schematic view of the diving circuit of the liquid crystal panel in accordance with another embodiment of the present disclosure.

Furthermore, FIG. 6 is a schematic view of the diving circuit of the liquid crystal panel in accordance with another embodiment of the present disclosure. In the embodiment, the types of the first switch K5', the second switch K6', the third switch K7', and the fourth switch K8' are the same. The control line C includes a first clock control line C1 and a second clock control line C2, and a level of control signals outputted by the first control line C1 is opposite to the level of the control signals outputted by the second control line C2. Control ends of the first switch K5' and the third switch K7' are connected with the first clock control line C1, and control ends of the second switch K6' and the fourth switch K8' are connected with the second clock control line C2.

Input ends of the first switch K5' and the second switch K6' are the first input end 1' of the inversion switching circuit 30, and output ends of the first switch K5' and the second switch K6' are respectively the first output end 3' and the second output end 4' of the inversion switching circuit 30. Input ends of the third switch K7' and the fourth switch K8' are the second input end 2' of the inversion switching circuit 30, and output ends of the third switch K7' and the fourth switch K8' are respectively the first output end 3' and the second output end 4' of the inversion switching circuit 30.

In the embodiment, the first switch K5', the second switch K6', the third switch K7' and the fourth switch K8' are N-type TFTs or P-type TFTs.

Figure 7:
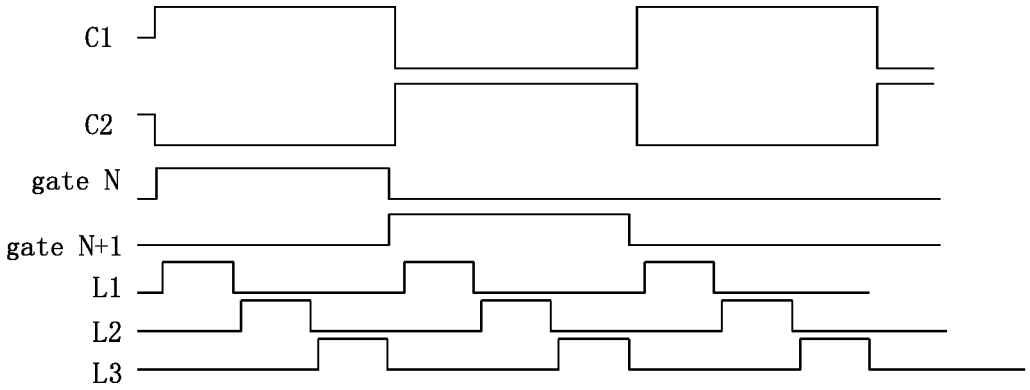
FIG. 7 is a timing diagram of the driving circuit of FIG. 6.

FIG. 7 is a timing diagram of the driving circuit of FIG. 6. Referring to FIG. 6 and FIG. 7, when the scan line gate N scans the N-th row of sub-pixels T, the first clock control line C1 outputs high level and the second clock control line C2 outputs low level, the first switch K5', and the third switch K7' are turned on, and the second switch K6' and the fourth switch K8' are turned off. At this time, The first data signals inputted by the first input end 1' of the inversion switching circuit 30 are transmitted to the odd-number columns of the sub-pixels T through the first switch K5' and the first type switches of the demultiplexer circuit 20, and the second data signals inputted by the second input end 2' of the inversion switching circuit 30 are transmitted to the even-number columns of the sub-pixels T through the third switch K7' and the second type switches of the demultiplexer circuit 20, such that the polarities of the data signals of the two adjacent sub-pixels T in the N-th row of sub-pixels T are opposite to each other. When the scan line gate N+1 scans the (N+1)-th row of sub-pixels T, the first clock control line C1 outputs low level and the second clock control line C3 outputs high level. At this time, the first switch K5' and the third switch K7' are turned off, and the second switch K6' and the fourth switch K8' are turned on. The first data signals inputted by the first input end 1' of the inversion switching circuit 30 are transmitted to the even-number columns of the sub-pixels T through the second switch K6' and the second type switches of the demultiplexer circuit 20, and the second data signals inputted by the second input end 2' of the inversion switching circuit 30 are transmitted to the odd-number columns of the sub-pixels T through the fourth switch K8' and the first type switches of the demultiplexer circuit 20, such that the polarities of the data signals of the two adjacent sub-pixels T in the (N+1)-th row of sub-pixels T are opposite to each other, and the polarities of the two adjacent sub-pixels T between the N-th row of the sub-pixels T and the (N+1)-th row of the sub-pixels T are also opposite to each other. Therefore, the dot-inversion of the liquid crystal panel is realized without changing the polarities of the data signals within a frame outputted by the driving chip. The distribution wires are configured for outputting the distribution signals to turn on each of the switches of the first type switches and the second type switches in different time intervals.

The driving circuit of the liquid crystal panel of the present disclosure adds the inversion switching circuit in the input side of the data signals of the demultiplexer circuit. The two input ends of the inversion switching circuit are alternatively connected with the two output ends of the inversion switching circuit while scanning a row of sub-pixels, such that the polarities of the data signals of the different type data lines inputted by the demultiplexer circuit are opposite to each other while scanning each row of the sub-pixels, and the dot-inversion of the liquid crystal panel is realized without changing the polarities of the driving signals outputted by the driving chip, so as to improve the image quality.

Furthermore, the present disclosure provides a liquid crystal display (LCD). The LCD includes a liquid crystal panel and a driving circuit. The liquid crystal panel includes a plurality of sub-pixels arranged in an array, a plurality of scan lines, and a plurality of data lines. The driving circuit is configured for driving the liquid crystal panel. The driving circuit of the embodiment can be one of the driving circuits of FIG. 2 to FIG. 7. Specifically referring to FIG. 2 to FIG. 5, and above description, the description is omitted here.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A driving circuit of a liquid crystal panel, comprising:

a demultiplexer circuit and an inversion switching circuit;

the demultiplexer circuit comprising first type switches, second type switches and a plurality of distribution wires; an input end of each of the first type switches being connected with a first output end of the inversion switching circuit, an output end of each of the first type switches being connected with one of a plurality of first data lines of the liquid crystal panel, and a control end of each of the first type switches being connected with one of the distribution wires;

an input end of each of the second type switches being connected with a second output end of the inversion switching circuit, an output end of each of the second type switches being connected with one of a plurality of second data lines of the liquid crystal panel, a control end of each of the second type switches being connected with one of the distribution wires;

each of the distribution wires being configured for outputting different distribution signals to turn on the corresponding switches in different time intervals within a scanning period; a set of the distribution wires being shared by the first type switches and the second type switches;

a first input end of the inversion switching circuit being configured for inputting first data signals of the first data lines, a second input end of the inversion switching circuit being configured for inputting second data signals of the second data lines; the first output end of the inversion switching circuit being connected with the input end of each of the first type switches; the second output end of inversion switching circuit being connected with the input end of each of the second type switches; the first input end and the second input end of the inversion switching circuit being respectively connected with the first output end and the second output end of the inversion switching circuit, and the first input end and the second input end of the inversion switching circuit being alternatively connected with the first output end and the second output end of the inversion switching circuit while scanning a row of sub-pixels;

wherein the first data lines and the second data lines are respectively odd-number columns of data lines and even-number columns of data lines, and a polarity of the first data signals is opposite to the polarity of the second data signals.

2. The driving circuit as claimed in claim 1, wherein the inversion switching circuit comprises:

a first switch unit, a control end of the first switch unit being connected with a control line, an input end of the first switch unit being the first input end of the inversion switching circuit, a first output and a second output end of the first switch unit being respectively the first output end and the second output end of the inversion switching circuit for controlling the input end of the first switch unit to be connected with the first output end or the second output end of the first switch unit according to control signals of the control line;

a second switch unit, a control end of the second switch unit being connected with the control line, an input end of the second switch unit being the second input end of the inversion switching circuit, a first output end and a second output end of the second switch unit being respectively the first output end and the second output end of the inversion switching circuit for controlling the input end of the second switch unit to be connected with the first output end or the second output end of the second switch unit according to the control signals of the control line;

the control line being configured for providing the control signals to control the input end of the first switch unit and the input end of the second switch unit to be respectively connected with the first output end and the second output end of the inversion switching circuit.

3. The driving circuit as claimed in claim 2, wherein the first switch unit comprises a first switch and a second switch; control ends of the first switch and the second switch are connected with the control line, output ends of the first switch and the second switch are respectively the first output end and the second output end of the first switch unit; and the second switch unit comprises a third switch and a fourth switch; control ends of the third switch and the fourth switch are connected with the control line, output ends of the third switch and the fourth switch are respectively the first output end and the second output end of the second switch unit.

4. The driving circuit as claimed in claim 3, wherein the control line is a clock control line, and the control ends of the first switch, the second switch, the third switch and the fourth switch are connected with the clock control line; and a type of the first switch is the same as the type of the third switch, and the type of the second switch is the same as the type of the fourth switch.

5. The driving circuit as claimed in claim 4, wherein the first switch and the third switch are N-type thin film transistors (TFTs); and the second switch and the fourth switch are P-type TFTs.

6. The driving circuit as claimed in claim 3, wherein the control line comprises a first clock control line and a second clock control line, and a level of control signals outputted by the first clock control line is opposite to the level of the control signals outputted by the second clock control line;

the control ends of the first switch and the third switch are connected with the first clock control line, and the control ends of the second switch and the fourth switch are connected with the second control line;

the type of the first switch, the second switch, the third switch, and the fourth switch are the same.

7. The driving circuit as claimed in claim 6, wherein the first switch, the second switch, the third switch, and the fourth switch are N-type TFTs or P-type TFTs.

8. A driving circuit of liquid crystal panel, comprising:

a demultiplexer circuit comprising a first input end and a second input end, the demultiplexer circuit being configured for outputting data signals inputted by the first input end to first data lines of the liquid crystal panel, and for outputting data signals inputted by the second input end to second data lines of the liquid crystal panel, wherein each of the data lines is connected with a row of sub-pixels; and an inversion switching circuit, a first input end of the inversion switching circuit being configured for inputting the first data signals, a second input end of the inversion switching circuit being configured for inputting the second data signals, a first output end of the inversion switching circuit is connected with the first input end of the demultiplexer circuit, a second output end of the inversion switching circuit is connected with the second input end of the demultiplexer circuit, the first input end and the second input end of the inversion switching circuit are respectively connected with the first output end and the second output end of the inversion switching circuit, and the first input end and the second input end of the inversion switching circuit being alternatively connected with the first output end and the second output end of the inversion switching circuit while scanning a row of the sub-pixels;

wherein the first data lines and the second data lines are respectively odd-number columns of data lines and even-number columns of data lines, and a polarity of the first data signals is opposite to the polarity of the second data signals.

9. The driving circuit as claimed in claim 8, wherein the inversion switching circuit comprises:

a first switch unit, a control end of the first switch unit being connected with a control line, an input end of the first switch unit being the first input end of the inversion switching circuit, a first output and a second output end of the first switch unit being respectively the first output end and the second output end of the inversion switching circuit for controlling the input end of the first switch unit to be connected with the first output end or the second output end of the first switch unit according to control signals of the control line;

a second switch unit, a control end of the second switch unit being connected with the control line, an input end of the second switch unit being the second input end of the inversion switching circuit, a first output end and a second output end of the second switch unit being respectively the first output end and the second output end of the inversion switching circuit for controlling the input end of the second switch unit to be connected with the first output end or the second output end of the second switch unit according to the control signals of the control line;

the control line being configured for providing the control signals to control the input end of the first switch unit and the input end of the second switch unit to be respectively connected with the first output end and the second output end of the inversion switching circuit.

10. The driving circuit as claimed in claim 9, wherein the first switch unit comprises a first switch and a second switch; control ends of the first switch and the second switch are connected with the control line, output ends of the first switch and the second switch are respectively the first output end and the second output end of the first switch unit; and the second switch unit comprises a third switch and a fourth switch; control ends of the third switch and the fourth switch are connected with the control line, output ends of the third switch and the fourth switch are respectively the first output end and the second output end of the second switch unit.

11. The driving circuit as claimed in claim 10, wherein the control line is a clock control line, and the control ends of the first switch, the second switch, the third switch and the fourth switch are connected with the clock control line; and a type of the first switch is the same as the type of the third switch, and the type of the second switch is the same as the type of the fourth switch.

12. The driving circuit as claimed in claim 11, wherein the first switch and the third switch are N-type thin film transistors (TFTs); and the second switch and the fourth switch are P-type TFTs.

13. The driving circuit as claimed in claim 10, wherein the control line comprises a first clock control line and a second clock control line, and the control signals in level outputted by the first clock control line is opposite to the control signals in level outputted by the second clock control line;

the control ends of the first switch and the third switch are connected with the first clock control line, and the control ends of the second switch and the fourth switch are connected with the second control line;

the type of the first switch, the second switch, the third switch, and the fourth switch are the same.

14. The driving circuit as claimed in claim 13, wherein the first switch, the second switch, the third switch, and the fourth switch are N-type TFTs or P-type TFTs.

15. The driving circuit as claimed in claim 8, wherein the demultiplexer circuit comprises first type switches, second type switches and a plurality of distribution wires;

an input end of each of the first type switches is connected with the first output end of the inversion switching circuit, an output end of each of the first type switches being connected with one of the first data lines of the liquid crystal panel, and a control end of each of the first type switches being connected with one of the distribution wires;

an input end of each of the second type switches is connected with a second output end of the inversion switching circuit, an output end of each of the second type switches being connected with one of the second data lines of the liquid crystal panel, a control end of each of the second type switches being connected with one of the distribution wires;

each of the distribution wires is configured for outputting different distribution signals to turn on the corresponding switches in different time intervals within a scanning period.

16. The driving circuit as claimed in claim 15, wherein the first type switches and the second type switches are P-type thin film transistors (TFTs) or N-type TFTs.

17. A liquid crystal display, comprising:

a driving circuit and a liquid crystal panel, the liquid crystal panel comprising a plurality of data lines, a plurality of scan lines, and a plurality of pixels, the pixels comprising a plurality of sub-pixels; the driving circuit being configured for driving the liquid crystal panel;

wherein the driving circuit comprises;

a demultiplexer circuit comprising a first input end and a second input end, the demultiplexer circuit being configured for outputting data signals inputted by the first input end to first data lines of the liquid crystal panel, and for outputting data signals inputted by the second input end to second data lines of the liquid crystal panel, wherein each of the data lines is connected with a row of the sub-pixels;

an inversion switching circuit, a first input end of the inversion switching circuit being configured for inputting the first data signals, a second input end of the inversion switching circuit being configured for inputting the second data signals, a first output end of the inversion switching circuit is connected with the first input end of the demultiplexer circuit, a second output end of the inversion switching circuit is connected with the second input end of the demultiplexer circuit, the first input end and the second input end of the inversion switching circuit are respectively connected with the first output end and the second output end of the inversion switching circuit, and the first input end and the second input end of the inversion switching circuit being alternatively connected with the first output end and the second output end of the inversion switching circuit while scanning a row of the sub-pixels;

wherein the first data lines and the second data lines are respectively odd-number columns of data lines and even-number columns of data lines, and a polarity of the first data signals is opposite to the polarity of the second data signals.

18. The liquid crystal display as claimed in claim 17, wherein the inversion switching circuit comprises:

a first switch unit, a control end of the first switch unit being connected with a control line, an input end of the first switch unit being the first input end of the inversion switching circuit, a first output and a second output end of the first switch unit being respectively the first output end and the second output end of the inversion switching circuit for controlling the input end of the first switch unit to be connected with the first output end or the second output end of the first switch unit according to control signals of the control line;

a second switch unit, a control end of the second switch unit being connected with the control line, an input end of the second switch unit being the second input end of the inversion switching circuit, a first output end and a second output end of the second switch unit being respectively the first output end and the second output end of the inversion switching circuit for controlling the input end of the second switch unit to be connected with the first output end or the second output end of the second switch unit according to the control signals of the control line;

the control line being configured for providing the control signals to control the input end of the first switch unit and the input end of the second switch unit to be respectively connected with the first output end and the second output end of the inversion switching circuit.

19. The liquid crystal display as claimed in claim 18, wherein the first switch unit comprises a first switch and a second switch; control ends of the first switch and the second switch are connected with the control line, output ends of the first switch and the second switch are respectively the first output end and the second output end of the first switch unit; and the second switch unit comprises a third switch and a fourth switch; control ends of the third switch and the fourth switch are connected with the control line, output ends of the third switch and the fourth switch are respectively the first output end and the second output end of the second switch unit.

* * * * *